US011536524B2

(12) United States Patent
Caudle et al.

(10) Patent No.: US 11,536,524 B2
(45) Date of Patent: Dec. 27, 2022

(54) COMPOSITE MODULAR RIFLE

(71) Applicants: Carl E Caudle, Moses Lake, WA (US); Nathanel J Caudle, Moses Lake, WA (US)

(72) Inventors: Carl E Caudle, Moses Lake, WA (US); Nathanel J Caudle, Moses Lake, WA (US)

( * ) Notice: Subject to any disclaimer, the term of this patent is extended or adjusted under 35 U.S.C. 154(b) by 0 days.

(21) Appl. No.: 17/476,270

(22) Filed: Sep. 15, 2021

(65) Prior Publication Data

US 2022/0136788 A1 May 5, 2022

Related U.S. Application Data

(60) Provisional application No. 63/078,613, filed on Sep. 15, 2020.

(51) Int. Cl.

| | |
|---|---|
| ***F41A 11/02*** | (2006.01) |
| ***F41A 3/66*** | (2006.01) |
| ***F41A 3/22*** | (2006.01) |
| ***F41A 19/15*** | (2006.01) |

(52) U.S. Cl.

CPC *F41A 3/66* (2013.01); *F41A 3/22* (2013.01); *F41A 19/15* (2013.01)

(58) Field of Classification Search

CPC .. F41A 11/02; F41A 11/04; F41A 3/66; F41A 19/15; F41C 7/11

See application file for complete search history.

(56) References Cited

U.S. PATENT DOCUMENTS

| | | | | |
|---|---|---|---|---|
| 10,345,074 | B1 * | 7/2019 | Zamlinskiy | F41C 23/10 |
| 2017/0122684 | A1 * | 5/2017 | Drake | F41A 35/06 |
| 2017/0227314 | A1 * | 8/2017 | Owens | F41A 11/02 |
| 2020/0400399 | A1 * | 12/2020 | Burke | F41A 11/02 |
| 2021/0080221 | A1 * | 3/2021 | Alber | F41A 3/66 |

* cited by examiner

*Primary Examiner* — J. Woodrow Eldred

(57) ABSTRACT

A modular bolt action rifle is provided, having an upper receiver configured to receive a bolt action bolt housing and bolt and a first universal fitting at a front of the upper receiver configured to receive one of a plurality of commonly sourced rifle barrels, and a lower receiver integral to or coupled to the upper receiver. The lower receiver is configured to receive commonly sourced fire control group components and a commonly sourced bolt action trigger mechanism. The lower receiver includes a second universal fitting at a rear of the lower receiver configured to receive one of a plurality of commonly sourced butt stocks.

20 Claims, 6 Drawing Sheets

Example Composite Modular Rifles

Example Composite Modular Rifles

COMPOSITE MODULAR RIFLE

PRIORITY CLAIM AND CROSS-REFERENCE TO RELATED APPLICATION

This application claims the benefit under 35 U.S.C. § 119(e)(1) of U.S. Provisional Application No. 63/078,613, filed Sep. 15, 2020, which is hereby incorporated by reference in its entirety.

BACKGROUND

Due to the popularity of bolt action rifles, their increased accuracy, and the enacting of laws restricting semi-automatic assault rifles in some jurisdictions, the conversion of semi-automatic AR styled rifles into manually operated rifles has gained popularity. The prior art shows some examples of manually operated single-shot conversions of semi-automatic style rifles, including component swaps to remove the semi-automatic capability of the rifles. However, the prior art components tend to be proprietary in nature and do not often allow interchangeability between components of different manufacturers (e.g., no open sourcing of components).

One patented example of a prior art conversion kit is U.S. Pat. No. 9,279,628 to Chris Pollack of Carmel, N.Y., USA. The conversion kit disclosed in the '628 patent is like many others in the prior art, in that the upper receiver of an AR styled assault rifle is replaced by a modified upper receiver to ensure single-action, the bolt carrier of the AR rifle is replaced by a modified bolt carrier for single round use, the traditional charging handle is removed, and a modified charging handle configured to be attached to the modified bolt carrier is added. The gas charging components of the rifle are removed and the gas port(s) in the barrel are plugged.

The '628 patent describes how the modified upper receiver is configured to be received by the existing lower receiver of the AR-style rifle, with the modified upper receiver coupled to the existing lower receiver as part of the conversion. The converted AR rifle retains all of the other existing components, including all of the firing control group components of the AR rifle. Accordingly, the conversion kit described by the '628 patent results in a rifle that operates the same as before the conversion, when the charging handle is activated (e.g., pulled back), but no longer has the capability for semi-automatic operation after that point. Instead, the charging handle is activated before each shot is fired. Single-shot conversions such as these are not effectively bolt-action rifles, but semi-automatic rifles that no longer have the capability for semi-automatic operation.

SUMMARY

There are tens of millions of AR styled assault rifles in America today. With the western-trained allies also using the AR styled assault rifles, this makes the AR styled assault rifle one, if not the most, prolific rifles in the world. It represents a 10 billion dollar a year industry.

The key advantage of a Composite Modular Rifle is its modular design. This modular design allows a person with limited knowledge and skill to quickly exchange available components and accessories on the modular rifle, such as barrels, stocks, butt stocks, and so forth, or to change between calibers and configurations as desired, by exchanging such items. For instance, the receiver can be used with three or more calibers of ammunition (e.g. 223, 22LR, 5.56 NATO, 40, 9 mm, 10 mm, 45, etc.).

The disclosure herein uses the Composite Modular Rifle's modularity and adaptability to common components with several unique enhancements. For instance, a bolt action Composite Modular Rifle may be designed to look like an AR styled assault rifle, and may use some components common to AR styled assault rifles, including barrels and bolts. Additional components may include common sourced bolt action rifle components, such as trigger mechanisms.

Alternately, a bolt action Composite Modular Rifle may be designed to look like other rifles, including semi-automatic or bolt action rifles.

BRIEF DESCRIPTION OF THE DRAWINGS

The detailed description is set forth with reference to the accompanying figures. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Figure 1A:
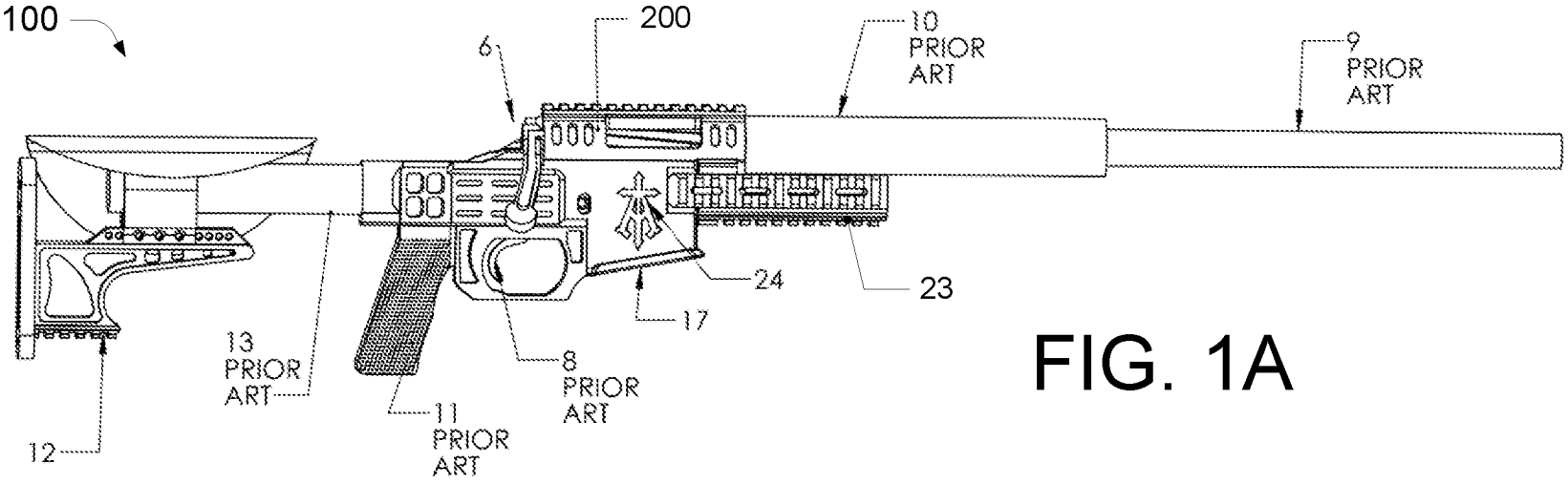
FIGS. 1A and 1B show right side views of assembled Composite Modular Rifles, according to two embodiments.
Figure 1B:
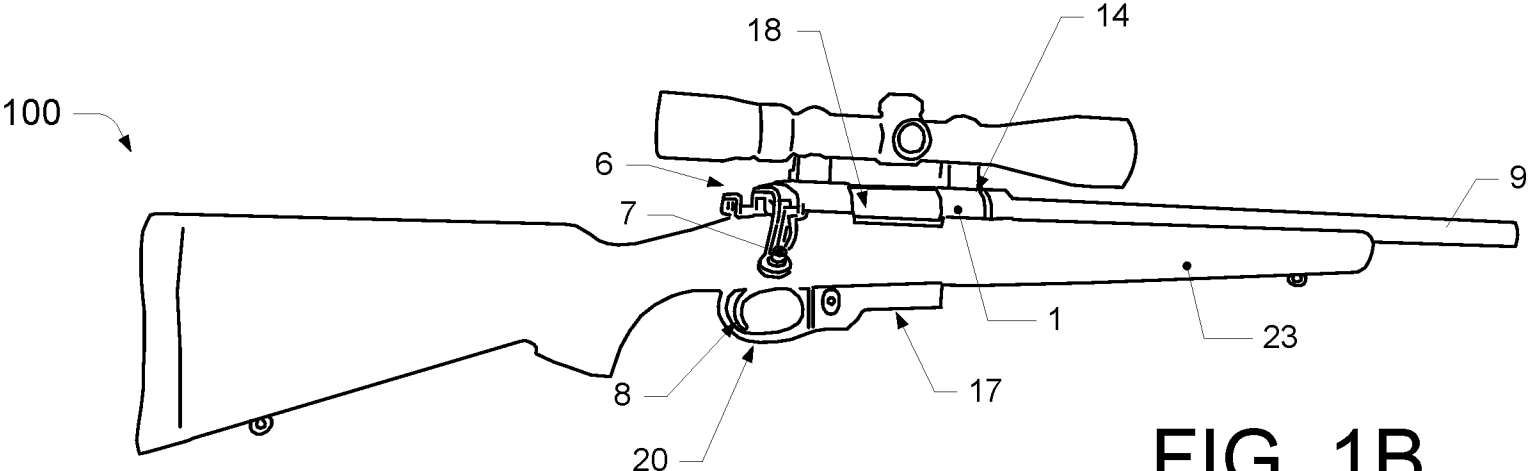

Referring to FIGS. 1A and 1B, representative implementations of devices and techniques provide a bolt action rifle 100 modularly configured from one or more commonly sourced rifle components and additional novel key components. The modular configurable rifle 100 disclosed herein may use one or more of a barrel 9, a bolt 4, a magazine 11, and/or furniture (e.g., commonly sourced components) that may be configured to be used with AR styled assault rifles as original or custom components for the rifles. These components may be combined with one or more novel key components, such as a receiver 1 or 2 or 200, one or more stock components 23, a bolt housing 6, and/or a bolt 5 to form a modular bolt action rifle 100.

An example Composite Modular Rifle 100 can include components such as an upper receiver 1 or 2 and a lower receiver 40 or a single unit receiver 200 comprising an upper and lower receiver combination unit that are custom formed using emerging technologies and materials (e.g., 3D printing or molding with plastics or composites, fiberglass, polymers, and so forth), to be compatible with commonly sourced barrels 9, bolts 4, magazines, trigger mechanisms 8, grips 11, butt stock components 12, and the like, in a wide range of calibers and cartridge sizes.

Figure 2:
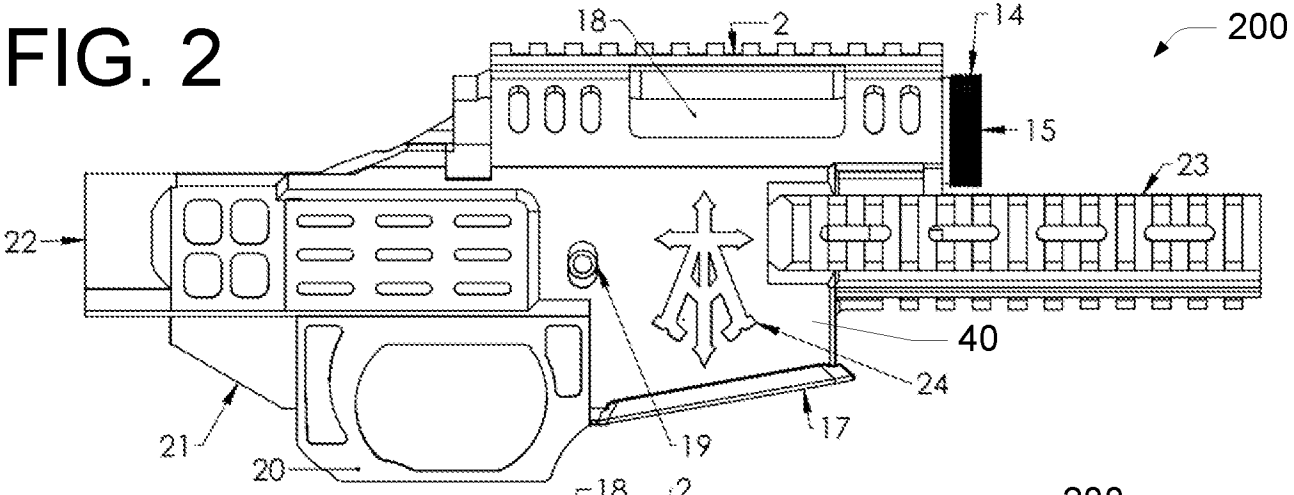
FIG. 2 shows a right side view of an example receiver and stock, as a single solid unit, according to an embodiment.
Figure 3:
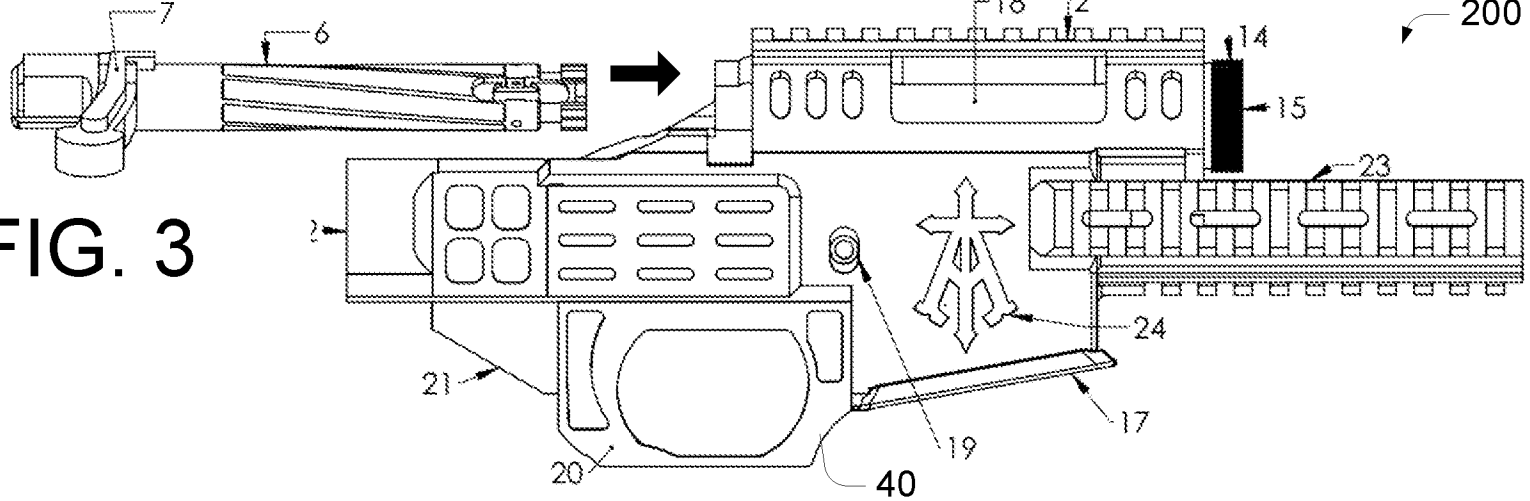
FIG. 3 shows a right side view of the example receiver and stock, as a single solid unit, and includes a side view of an example bolt housing, according to an embodiment.

In some embodiments, as shown in FIGS. 2 and 3, a unit receiver 200 (upper and lower combination) and a stock 23 may be combined into a novel single unit 200 as well. Alternately, a novel unit receiver 200 may be used with commonly sourced stock components, or the like. In other embodiments, the bolt housing and bolt may be combined into a novel single unit (e.g., machined as a single part). Alternately, a commonly sourced bolt housing may be combined with a novel bolt.

In contrast to the '628 patent discussed above, and the many manual conversion schemes like it, the Composite Modular Rifle 100 does not comprise a conversion kit for an AR rifle (or any other style of rifle). Rather, the Composite Modular Rifle 100 comprises a customizable modular bolt action rifle. While the Composite Modular Rifle 100 can be designed and formed to have the appearance of an AR rifle, as shown in the accompanying drawings (see FIG. 1A), the Composite Modular Rifle 100 can also be designed and formed to have the appearance of other styles of rifles, including sporting rifles and other commonly recognizable bolt action rifle configurations (see FIG. 1B). Since the receiver unit 200 can be formed with emerging technologies and materials (3D printing, composites, fiberglass, carbon fiber for example), the receiver unit 200 can be formed to take any appearance desired, while retaining the capability of being used with commonly sourced barrels 9, stocks 23, grips 11, and so forth.

The modularity of the Composite Modular Rifle 100 means that the receiver unit 200 has multiple areas that use common fittings to attach commonly sourced components. For example, at the front of the receiver unit 200, there is a fitting 15 that will accept commonly sourced barrels 9, including standard barrels intended for AR styled rifles as well as other standard and custom barrels 9. At the back of the receiver unit 200 there is a fitting 22 that will accept commonly sourced butt stocks 12, including butt stocks intended for AR styled rifles as well as other standard and custom butt stocks 12. At the bottom rear of the receiver unit 200 there is a fitting 21 that will accept commonly sourced grips 11, including grips intended for AR styled rifles as well as other standard and custom grips 11.

In contrast to the conversion kits shown in the prior art, the Composite Modular Rifle 100 does not use the lower receiver or the firing control group from an AR styled rifle. The receiver unit 200 of the Composite Modular Rifle 100 is compatible with various standard and custom trigger mechanisms 8, including commonly sourced trigger mechanisms used in other bolt action rifles. The magazine well 17 of the receiver unit 200 is compatible with common magazines intended for a selected cartridge size. In various examples, magazines intended for AR styled rifles or other rifles may be used with the receiver unit 200 of the Composite Modular Rifle 100.

In contrast to the conversion kits shown in the prior art, the Composite Modular Rifle 100 does not include an upper receiver capable of swapping with the upper receiver of an AR styled rifle. The upper receiver 1 or 2 (when it is a separate unit) may not be compatible with the lower receiver of an AR styled rifle. Rather, the upper receiver 1 or 2 may be compatible with a custom lower receiver 40, or the like (see for example, FIG. 1B).

Prior art designs also tend to have fixed bolt lift rotations of 60 or 90 degrees, and generally need to be constructed using traditional materials and methods. However, the Composite Modular Rifle 100 includes the capability for bolt lift rotations of approximately 22.5 degrees, while maintaining bolt lock with the use of a unique passive safety latch incorporated with the bolt housing 3.

The present disclosure relates to a manually operated modular bolt action rifle system 100 that utilizes some commonly sourced rifle components along with some key novel rifle components. Bolt action rifles typically have barrels rigidly fixed into the receivers and matched components. The present disclosure describes a bolt action rifle 100 with a barrel 9 that is removably attached to the receiver 2 (e.g., with a screw-on fitting 15, or the like). The barrel 9 may be a commonly sourced assault rifle barrel, a custom manufactured barrel, or other barrel 9 with removable fitting.

Bolt action rifles are not typically modular by design and require a high degree of knowledge and skill to change parts and maintain them. The present disclosure describes a bolt action rifle 100 that is modular by design, formed from a combination of commonly sourced rifle components (e.g., one or more of a barrel 9, bolt 4 or 5, magazine and stocks 23) and novel, specially manufactured components (e.g., one or more of a receiver 1 or 2, one or more stock components 23, bolt housing 6, and/or bolt 5) to form the modular bolt action rifle 100. The modular design is such that very little knowledge or skill is needed to change and maintain the parts and components, including assembly and disassembly of the modular rifle 100.

Bolt action rifles typically are constructed from hardened steel components to withstand heavy impact trauma as the firearm is discharged. The present disclosure describes a bolt action rifle 100 with novel components (such as the receiver 1 or 2 and one or more stock components) that may be constructed from synthetic materials, ceramics, composites, and ferrous and non-ferrous materials. The components may be cast, molded, 3D-printed, CNC milled, or otherwise formed or machined, based on the materials used.

The components of the modular rifle 100 can be manufactured using traditional methods, but are specifically designed (e.g., size and shape, as well as number of component parts) to take advantage of emerging materials and rapid construction advancements. Thus, manufacturing costs, materials costs, and cost of maintenance or upgrades may be greatly reduced while maintaining the necessary integrity and robust characteristics of the components.

In some embodiments, the receiver 2 and stock 23 can be manufactured as a single solid unit 200. In other embodiments, the receiver 2 and stock 23 can be manufactured as separate modular components that attach with tool-less fitments.

In various embodiments, the modular rifle 100 can be readily personalized, including cartridges, barrels, and rifle configurations. For example, the upper portion of the novel receiver 2 can be formed to accommodate any cartridge size desired (or a range of cartridge sizes). The novel bolt housing 3 and bolt (e.g., commonly sourced bolt 4 or modified bolt 5) are selected to accept the cartridge size chosen. The lower portion of the novel receiver 200 is formed with an integral magazine well 17, to accept the magazine size desired for the chosen cartridge size.

The bolt housing unit 3 has a unique passive safety latch to keep the bolt latched in place during firing. A bolt lift rotation of approximately 22.5 degrees is available (e.g., ranges from 20 degrees to 90 degrees may be available), in contrast to current bolt action rifles that have lift rotation amounts of 60 and 90 degrees.

Example Embodiments: Composite Modular Rifle

Referring to FIGS. 1-8, the following part number designations are used throughout:

| Part number | description | FIG.(S) |
|---|---|---|
| 1 | Integrated Upper Receiver | 4, 5 |
| 2 | Modular Upper Receiver | 1, 2, 3 |
| 3 | Bolt housing without bolt | 6, 8 |
| 4 | Prior art AR styled bolt | 6, 8 |
| 5 | Modified bolt | 6, 8 |
| 6 | Bolt housing with bolt as a solid unit | 1, 3, 4, 7 |
| 7 | Bolt handle passive safety latch | 4 |
| 8 | Prior art bolt action trigger | 1 |
| 9 | Prior art AR styled barrel | 1, 8 |
| 10 | Prior Art AR styled handguard | 1 |
| 11 | Prior Art AR styled grip | 1 |
| 12 | Adjustable Butt stock and cheek pad assembly | 1 |
| 13 | Prior Art AR Butt stock tube | 1 |
| 14 | Receiver threads | 2, 3, 4, 5 |
| 15 | Area to receive barrel extension on prior art AR styled barrel | 2, 3, 4, 5 |
| 16 | Receiver recoil lug | 4, 5 |
| 17 | Magazine well | 1, 2, 3, 4, 5 |
| 18 | Receiver ejection port | 2, 3, 4, 5 |
| 19 | Magazine release | 2, 3 |
| 20 | Trigger guard | 2, 3 |
| 21 | AR styled grip attachment | 2, 3 |
| 22 | AR styled butt stock tube attachment | 2, 3 |
| 23 | Optional accessory rails | 2, 3 |
| 24 | Inventors logo | 1, 2, 3 |
| 25 | Bolt stop | 5 |
| 26 | Retaining pin for bolt housing | 6 |
| 27 | Prior art barrel extension | 8 |
| 28 | Bolt housing guide | 7 |
| 200 | Unit integrated Receiver | 1, 2, 3 |
| 40 | Modular Lower Receiver | 1, 2, 3 |

Referring to FIGS. 1A and 1B

Two example Composite Modular rifles 100 are shown at FIGS. 1A and 1B. The CMR rifle 100 at FIG. 1A is shown with a novel solid receiver unit 200, comprising a receiver and stock manufactured as one homogeneous unit, according to an embodiment. The unit 200 is shown with a magazine well 17 configured to accept AR styled magazines. The CMR rifle 100 at FIG. 1B is shown with a novel bolt-action upper receiver 1, according to an embodiment. The CMR rifle 100 at FIG. 1B is also shown with a magazine well 17 configured to accept commonly sourced magazines.

Referring to both CMR rifles 100: a bolt housing 6 is shown that may include either an AR styled bolt 4 or a modified bolt 5. In various embodiments, the bolt (either type, 4 or 5) may be integral to the bolt housing 6 (for instance the bolt 4 or 5 and the bolt housing 3 may be machined as solid unit). The inventor's logo (24) is optionally included, as well as an adjustable butt stock and cheek pad 12 that may be assembled onto a prior art buttstock tube 13.

The embodiments may include a prior art AR styled barrel 9, an AR styled grip 11, and an AR styled handguard 10. Embodiments include a prior art bolt action trigger 8. Accordingly, the embodiments are comprised of combinations of novel components and commonly sourced components, such as AR components, resulting in bolt action rifles 100 that may resemble an AR style rifle (as shown at FIG. 1A), or other style sporting rifle (as shown at FIG. 1B). In other embodiments, the Composite Modular Rifle 100 can be comprised of barrels, grips, handguards, and so forth that are commonly sourced components of other rifle styles, resulting in a bolt action rifle 100 with a different appearance. In various alternate embodiments, fewer or more novel components may be included, resulting in more or fewer commonly sourced components, respectively.

Referring to FIG. 2

An example embodiment is shown of a solid receiver unit 200 comprising a receiver and stock manufactured as one homogeneous unit. The unit 200 is shown with a magazine well 17 configured to accept AR styled magazines, an ejection port 18 that can be located on the right or left side of the receiver unit 2, and receiver threads 14 to accept a prior art barrel nut or handguard 10. Also shown is a fitting 15 to receive a barrel extension 27 on a prior art barrel 9, the inventor's logo (24), a magazine release 19, a trigger guard 20, a grip attachment 21, a butt stock tube attachment 22, and optional accessory rails 23.

Referring to FIG. 3

An example embodiment is shown with a solid receiver unit 200 comprising a receiver 2 and stock 23 manufactured as one homogeneous unit 200, in relationship to a bolt housing 6 with either an AR styled bolt 4 or a modified bolt 5 machined into the face of the bolt housing 6. The bolt handle passive safety latch 7 keeps the locking lugs of the bolt 4 or 5 in alignment with the prior art barrel extension 27, preventing unintentional unlocking of the mechanism.

The unit 200 is shown with a magazine well 17 to accept AR styled magazines (for example), an ejection port 18 that can be located on the right or left side of the receiver unit 200, receiver threads 14 to accept a prior art barrel nut or handguard 10, a fitting 15 to receive a barrel extension 27 on a prior art barrel 9.

Figure 4:
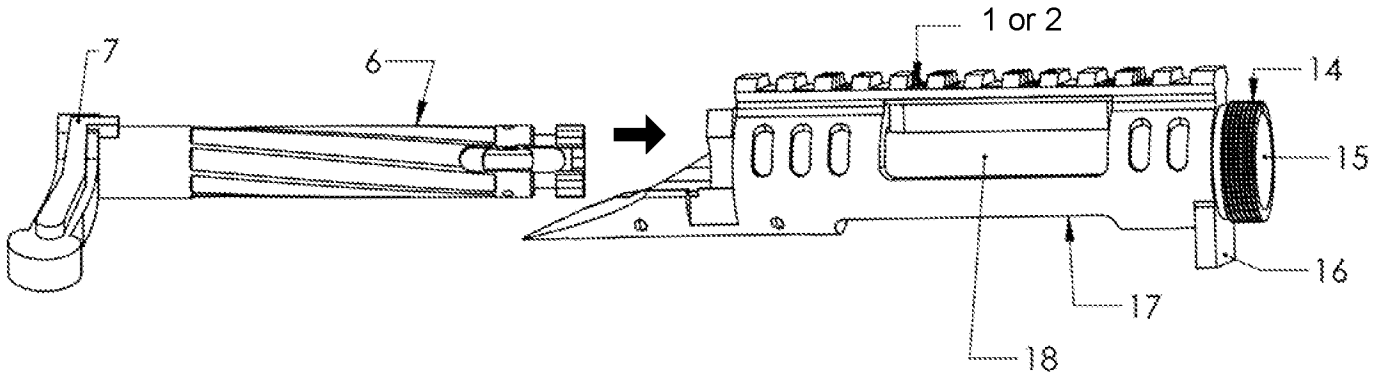
FIG. 4 shows a right side view of example receiver and bolt housing, according to an embodiment.

Referring to FIG. 4

In this embodiment, an upper receiver 1 is shown with an ejection port 18 that can be located on the right or left side of the upper receiver 1, receiver threads 14 to accept a prior art barrel nut (not shown) or handguard 10, a fitting 15 to receive a barrel extension 27 on a barrel 9, a recoil lug 16, a magazine well 17, a bolt housing 6 with either an AR styled bolt 4 or a modified bolt 5 machined into it as solid unit 6, and a bolt handle passive safety latch 7.

Figure 5:
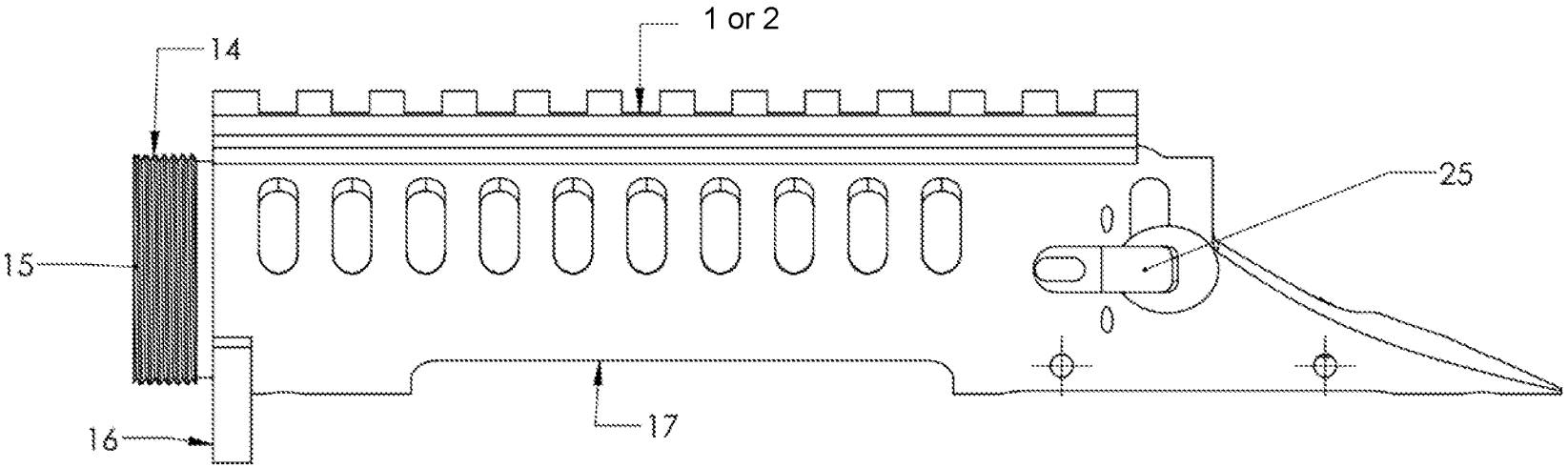
FIG. 5 shows a left side view of an example upper receiver with bolt stop, according to an embodiment.

Referring to FIG. 5

In this embodiment, an upper receiver 1 is shown with receiver threads 14 to accept a prior art barrel nut or handguard 10, a fitting 15 to receive a barrel extension 27 on a prior art barrel 9, a recoil lug 16, a magazine well 17, and a bolt stop 25.

Figure 6:
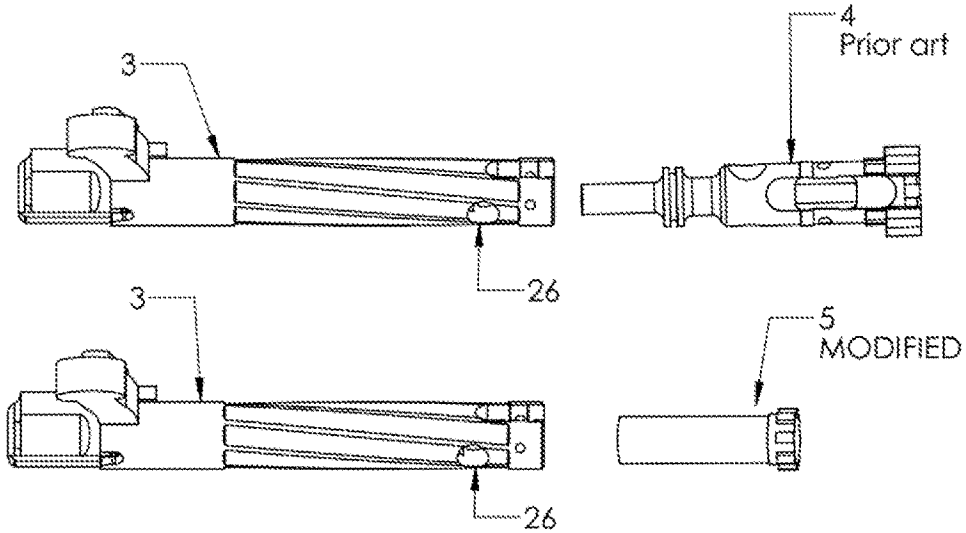
FIG. 6 shows right side views comparing an example bolt housing with a prior art AR styled bolt to an example bolt housing with a modified bolt, according to various embodiments.

Referring to FIG. 6

FIG. 6 shows right side views comparing an example bolt housing 3 with a prior art AR styled bolt 4 to the example bolt housing 3 with a modified bolt 5, according to various embodiments. The views show the bolt housing 3 with a retaining pin 26 that serves to hold the bolt 4 or 5 into the housing 3. As discussed above, the bolt 4 or 5 may be integral to the bolt housing 3, forming the combined bolt housing unit 6, or in some embodiments, the bolt 4 or 5 may be a separate component, held into the bolt housing 3 by the retaining pin 26.

Figure 7:
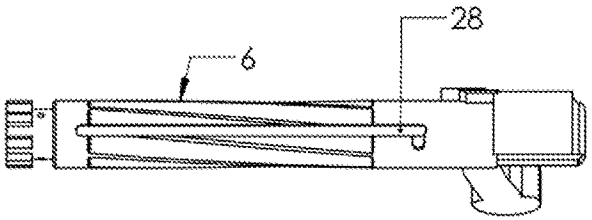
FIG. 7 shows a left side perspective view of an example bolt housing having a guide slot, according to an embodiment.

Referring to FIG. 7

FIG. 7 shows the bolt housing unit 6 with either an AR styled bolt 4 or a modified bolt 5 machined into it as solid unit 6 and a slot 28 serving as the bolt movement guide within the receiver 1 or 2.

Figure 8:
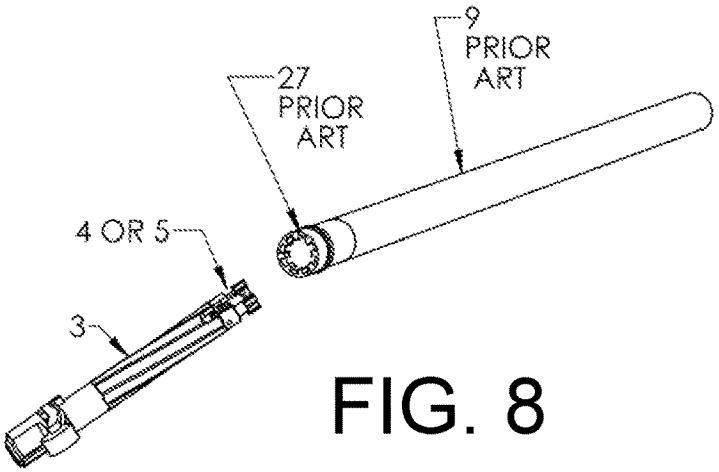
FIG. 8 shows a right side perspective view of an example assembled bolt housing and a prior art rifle barrel, according to an embodiment.

Referring to FIG. 8

FIG. 8 shows the relationship between the prior art barrel extension 27 which is fixed to the prior art barrel 9 and a bolt assembly 6 comprising the bolt housing 3 and an AR styled bolt 4 or a modified bolt 5.

Although various implementations and examples are discussed herein, further implementations and examples may be possible by combining the features and elements of individual implementations and examples.

Representative Process

Figure 9:
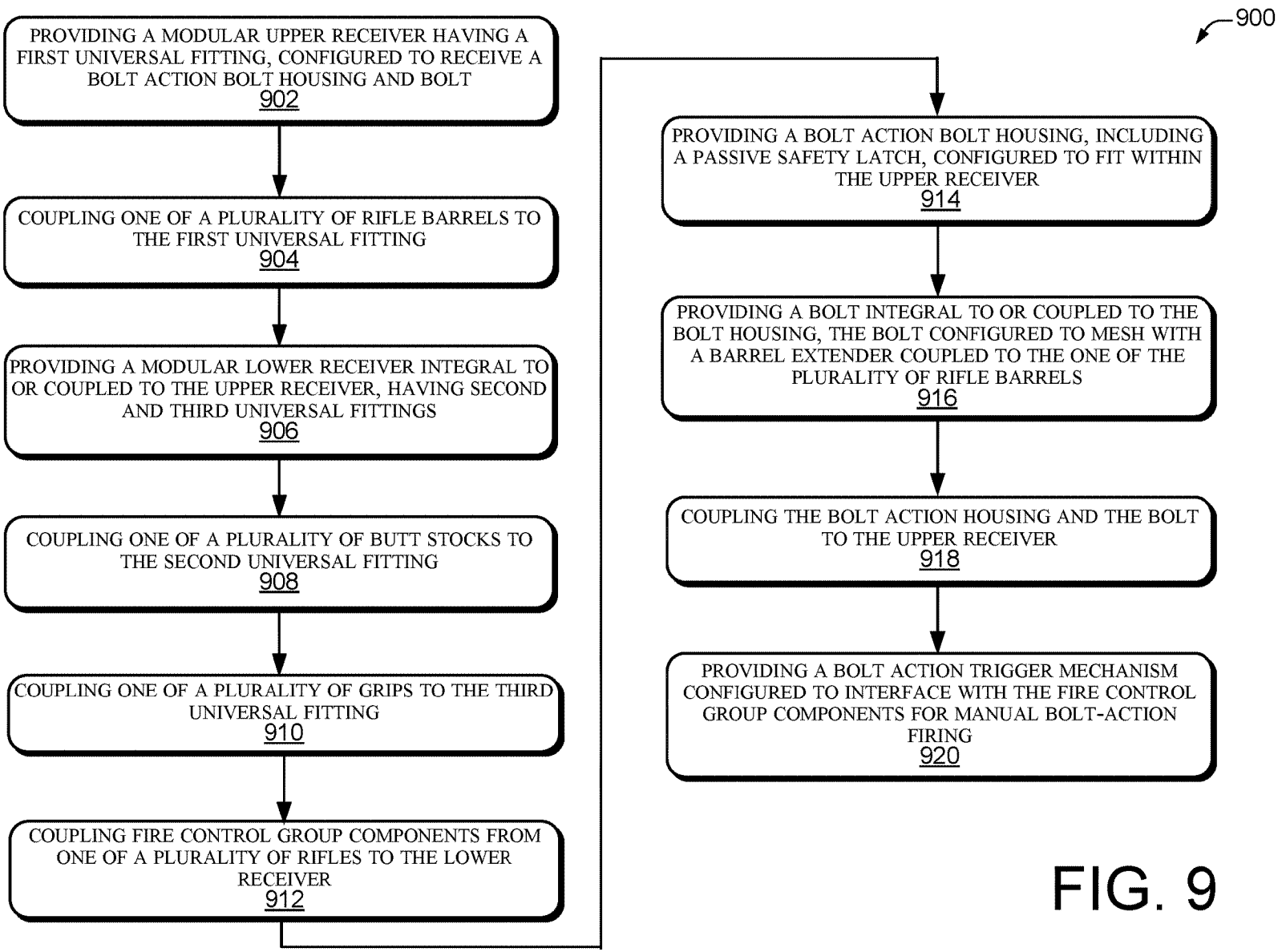
FIG. 9 is a flow chart for a method of forming a modular rifle.

FIG. 9 illustrates a representative process 900 for implementing techniques and/or devices relative to forming a modular rifle (such as a CMR 100, for example), according to various embodiments. The example process 900 is described with reference to FIGS. 1-8.

The order in which the process is described is not intended to be construed as a limitation, and any number of the described process blocks can be combined in any order to implement the process, or alternate processes. Additionally, individual blocks may be deleted from the process without departing from the spirit and scope of the subject matter described herein. Furthermore, the process can be implemented in any suitable hardware, software, firmware, or a combination thereof, without departing from the scope of the subject matter described herein.

At block 902, the process includes providing a modular upper receiver (such as the upper receiver 2, for example) configured to receive a bolt action bolt housing and bolt, the upper receiver including an ejection port on a side of the upper receiver and a first universal fitting at a front of the upper receiver configured to receive one of a plurality of rifle barrels. The fitting may be a universal fitting for AR style rifles, and the rifle barrels may be universal or custom formed. At block 904, the process includes coupling one of a plurality of rifle barrels to the first universal fitting.

At block 906, the process includes providing a modular lower receiver (such as the lower receiver 40, for example) integral to or coupled to the upper receiver, the lower receiver including a magazine well configured to receive a semi-automatic rifle magazine, a second universal fitting at a rear of the lower receiver configured to receive one of a plurality of butt stocks, and a third universal fitting at a bottom of the lower receiver configured to receive one of a plurality of grips, the lower receiver configured to receive fire control group components from a plurality of rifles.

At block 908, the process includes coupling one of a plurality of butt stocks to the second universal fitting. At block 910, the process includes coupling one of a plurality of grips to the third universal fitting. At block 912, the process includes coupling fire control group components from one of a plurality of rifles to the lower receiver. The butt stocks, grips, and fire control groups may be universal commonly sourced AR style components.

At block 914, the process includes providing a bolt action bolt housing, including a passive safety latch, configured to fit within the upper receiver. At block 916, the process includes providing a bolt integral to or coupled to the bolt housing, the bolt configured to mesh with a barrel extender coupled to or integral to the one of the plurality of rifle barrels. At block 918, the process includes coupling the bolt action housing and the bolt to the upper receiver.

At block 920, the process includes providing a bolt action trigger mechanism configured to interface with the fire control group components for manual bolt-action firing.

In one embodiment, the upper receiver and the lower receiver comprise a single integrated unit receiver (such as the receiver 200, for example). In another embodiment, the process includes providing an integrated rifle stock (or handguard) component, integral to the upper and/or lower receivers. For instance, the upper receiver, lower receiver, and rifle stock may be an integrated single unit. The single unit may be formed of composites, fiberglass, carbon fiber, plastics, or the like. In another embodiment, the bolt housing and the bolt comprise a single machined unit.

In alternate implementations, other techniques may be included in the process in various combinations, and remain within the scope of the disclosure.

Various modifications and changes can be made to the embodiments presented herein without departing from the broader spirit and scope of the disclosure. For example, features or aspects of any of the embodiments can be applied in combination with any other of the embodiments or in place of counterpart features or aspects thereof. Accordingly, the specification and drawings are to be regarded in an illustrative rather than a restrictive sense.

While the present disclosure has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the disclosure.

Although various implementations and examples are discussed herein, further implementations and examples may be possible by combining the features and elements of individual implementations and examples.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the claims.

What is claimed is:

1. A modular bolt action rifle, comprising:

a modular upper receiver configured to receive a bolt action bolt housing and bolt, the upper receiver including an ejection port on a side of the upper receiver and a first universal fitting at a front of the upper receiver configured to receive one of a plurality of rifle barrels;

a modular lower receiver integral to or coupled to the upper receiver, the lower receiver including a magazine well configured to receive a semi-automatic rifle magazine, a second universal fitting at a rear of the lower receiver configured to receive one of a plurality of butt stocks, and a third universal fitting at a bottom of the lower receiver configured to receive one of a plurality of grips, the lower receiver configured to receive fire control group components from a plurality of rifles;

a bolt action bolt housing, including a passive safety latch, configured to fit within the upper receiver;

a bolt integral to or coupled to the bolt housing, the bolt configured to mesh with a barrel extender coupled to the one of the plurality of rifle barrels; and a bolt action trigger mechanism configured to interface with the fire control group components for manually firing the bolt action rifle.

2. The modular bolt action rifle of claim 1, wherein the upper receiver and the lower receiver comprise a single integrated unit receiver.

3. The modular bolt action rifle of claim 2, wherein the single integrated unit receiver is formed of a composite material.

4. The modular bolt action rifle of claim 2, wherein the single integrated unit receiver is formed of fiberglass.

5. The modular bolt action rifle of claim 2, further comprising a composite rifle stock, and wherein the rifle stock is integral to the single integrated unit receiver.

6. The modular bolt action rifle of claim 2, wherein the single integrated unit receiver is a 3D printed component.

7. The modular bolt action rifle of claim 1, further comprising a composite rifle stock coupled to the upper receiver or the lower receiver.

8. The modular bolt action rifle of claim 1, wherein the bolt housing and the bolt comprise a single machined unit.

9. The modular bolt action rifle of claim 1, wherein the one of a plurality of rifle barrels, the semi-automatic rifle magazine, the one of a plurality of butt stocks, the one of a plurality of grips, and the bolt comprise AR-style assault rifle components.

10. A modular bolt action rifle, comprising:

a modular unit receiver comprising an integrated upper receiver and lower receiver configured to receive a bolt action bolt housing and bolt and fire control group components from a plurality of rifles, the unit receiver including:

an ejection port;

a magazine well configured to receive a semi-automatic rifle magazine;

a first universal fitting at a front of the unit receiver configured to receive one of a plurality of rifle barrels;

a second universal fitting at a rear of the unit receiver configured to receive one of a plurality of butt stocks; and a third universal fitting at a bottom of the unit receiver configured to receive one of a plurality of grips;

a bolt action bolt housing, including a passive safety latch, configured to fit within the unit receiver;

a bolt integral to or coupled to the bolt housing, the bolt configured to engage with the one of the plurality of rifle barrels; and a bolt action trigger mechanism configured to interface with the fire control group components for manually firing the bolt action rifle.

11. The modular bolt action rifle of claim 10, wherein the unit receiver is formed of a composite material.

12. The modular bolt action rifle of claim 10, further comprising a composite rifle stock integral to the unit receiver.

13. The modular bolt action rifle of claim 10, wherein the bolt is a customized bolt without gas management features.

14. The modular bolt action rifle of claim 10, wherein the bolt housing and the bolt comprise a single machined unit.

15. The modular bolt action rifle of claim 1, wherein a bolt lift rotation of the bolt is between 20 and 50 degrees.

16. The modular bolt action rifle of claim 1, wherein the unit receiver is configured to accept 3 or more calibers of ammunition.

17. A method, comprising:

providing a modular upper receiver configured to receive a bolt action bolt housing and bolt, the upper receiver including an ejection port on a side of the upper receiver and a first universal fitting at a front of the upper receiver configured to receive one of a plurality of rifle barrels;

coupling one of a plurality of rifle barrels to the first universal fitting;

providing a modular lower receiver integral to or coupled to the upper receiver, the lower receiver including a magazine well configured to receive a semi-automatic rifle magazine, a second universal fitting at a rear of the lower receiver configured to receive one of a plurality of butt stocks, and a third universal fitting at a bottom of the lower receiver configured to receive one of a plurality of grips, the lower receiver configured to receive fire control group components from a plurality of rifles;

coupling one of a plurality of butt stocks to the second universal fitting;

coupling one of a plurality of grips to the third universal fitting;

coupling fire control group components from one of a plurality of rifles to the lower receiver;

providing a bolt action bolt housing, including a passive safety latch, configured to fit within the upper receiver;

providing a bolt integral to or coupled to the bolt housing, the bolt configured to mesh with a barrel extender coupled to or integral to the one of the plurality of rifle barrels;

coupling the bolt action housing and the bolt to the upper receiver; and providing a bolt action trigger mechanism configured to interface with the fire control group components for manual bolt-action firing.

18. The method of claim 17, wherein the upper receiver and the lower receiver comprise a single integrated unit receiver.

19. The method of claim 17, wherein the bolt housing and the bolt comprise a single machined unit.

20. The method of claim 17, further comprising providing a composite rifle stock, and wherein the rifle stock is integral to the single integrated unit receiver.

* * * * *